US009987648B2

(12) United States Patent
Fujiwara et al.

(10) Patent No.: US 9,987,648 B2
(45) Date of Patent: Jun. 5, 2018

(54) TRIGGER-TYPE LIQUID JETTING DEVICE

(71) Applicants: Kotaro Fujiwara, Tokyo (JP); Shigeo Iizuka, Tokyo (JP)

(72) Inventors: Kotaro Fujiwara, Tokyo (JP); Shigeo Iizuka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days. days.

(21) Appl. No.: 15/119,621

(22) PCT Filed: Feb. 25, 2015

(86) PCT No.: PCT/JP2015/000963

§ 371 (c)(1),
(2) Date: Aug. 17, 2016

(87) PCT Pub. No.: WO2015/129269

PCT Pub. Date: Sep. 3, 2015

(65) Prior Publication Data

US 2017/0065994 A1 Mar. 9, 2017

(30) Foreign Application Priority Data

Feb. 28, 2014 (JP) ..... 2014-039946

(51) Int. Cl.
*B05B 11/00* (2006.01)
*B05B 1/12* (2006.01)
(Continued)

(52) U.S. Cl.
CPC ..... *B05B 11/3077* (2013.01); *B05B 11/0016* (2013.01); *B05B 11/0059* (2013.01);
(Continued)

(58) Field of Classification Search
CPC ..... B05B 11/3077; B05B 11/0016; B05B 11/0059; B05B 11/3016; B05B 11/3067;
(Continued)

(56) References Cited

U.S. PATENT DOCUMENTS 5,211,315 A 5/1993 Geier
2002/0066802 A1* 6/2002 Tada ..... B05B 7/0018 239/333

(Continued)

FOREIGN PATENT DOCUMENTS

JP H11-290731 A 10/1999
JP H11-309391 A 11/1999

(Continued)

OTHER PUBLICATIONS

Jun. 2, 2015 International Search Report issued in International Patent Application No. PCT/JP2015/000963.

(Continued)

*Primary Examiner* — Donnell Long
(74) *Attorney, Agent, or Firm* — Oliff PLC

(57) ABSTRACT

Provided is a trigger-type liquid dispenser (1) including an operating lever (6) held swingably by a main body portion (3) in which a pump is disposed and including a spring member (7) that imparts restoring force to the operating lever (6). The trigger-type liquid dispenser (1) is configured to draw, pressurize, and force-feed a content liquid contained in a container (C) to dispense the content liquid through a nozzle (5), by actuating the pump in response to the operating lever (6) being pulled repeatedly. The spring member (7) is held swingably with respect to the main body portion (3), and, in response to the operating lever (6) being pulled, the spring member (7) undergoes elastic deformation and swings with respect to the main body portion (3).

2 Claims, 4 Drawing Sheets

(51) Int. Cl.
*B05B 7/00* (2006.01)
*B05B 7/04* (2006.01)

(52) U.S. Cl.
CPC ..... *B05B 11/3011* (2013.01); *B05B 11/3016* (2013.01); *B05B 11/3067* (2013.01); *B05B 1/12* (2013.01); *B05B 7/005* (2013.01); *B05B 7/0425* (2013.01); *B05B 11/007* (2013.01); *B05B 11/0008* (2013.01); *B05B 11/0032* (2013.01); *B05B 11/3074* (2013.01)

(58) Field of Classification Search
CPC ... B05B 11/3011; B05B 11/0032; B05B 1/12; B05B 11/007; B05B 11/0008; B05B 7/0425; B05B 7/005; B05B 11/3074
See application file for complete search history.

(56) References Cited

U.S. PATENT DOCUMENTS

2007/0210106 A1* 9/2007 Foster ..... B05B 11/3011 222/153.06
2007/0210117 A1* 9/2007 Foster ..... B05B 11/3011 222/340
2007/0215645 A1* 9/2007 Clynes ..... B05B 11/3077 222/340
2007/0215647 A1* 9/2007 Foster ..... B05B 11/3077 222/383.1
2014/0014691 A1* 1/2014 Foster ..... B05B 11/3011 222/383.1

FOREIGN PATENT DOCUMENTS

JP 2001-239193 A 9/2001
JP 2003-225595 A 8/2003
JP 2008-87808 A 4/2008
JP 4104743 B2 6/2008
JP 2012-101195 A 5/2012

OTHER PUBLICATIONS

Sep. 6, 2016 International Preliminary Report on Patentability issued in International Patent Application No. PCT/JP2015/000963.
Jun. 6, 2017 Office Action issued in Japanese Patent Application No. 2014-039946.
Sep. 18, 2017 Search Report issued in European Patent Application No. 15755881.8.
Feb. 8, 2018 Office Action issued in Chinese Patent Application No. 2015800101274.
Nov. 30, 2017 Office Action issued in Korean Patent Application No. 10-2016-7022478.
Oct. 26, 2017 Office Action issued in Canadian Patent Application No. 2,940,180.

* cited by examiner

TRIGGER-TYPE LIQUID JETTING DEVICE

TECHNICAL FIELD

The present disclosure relates to a trigger-type liquid jetting device (which is called the "trigger-type liquid dispenser" below), especially to a spring member that imparts restoring force to an operating lever used to actuate a pump of such a dispenser.

BACKGROUND

Trigger-type liquid dispensers are widely used in containers containing a content liquid, such as an antimold, a detergent, a sizing agent for textiles, household wax, a hair liquid, an aromatic, a repellent, a pesticide, and a medicine, and such a trigger-type liquid dispenser is mounted to a mouth of the container and injects the liquid contained therein in the form of a straight jet, mist, or foam by a pump, which is disposed in a main body portion thereof, being actuated in response to an operating lever being pulled (refer to Patent Literature 1, for example), thereby allowing the content liquid to be supplied efficiently.

As illustrated in FIG. 4, the dispenser includes an operating lever 100 (which is called the trigger in Patent Literature 1) and a spring member 200 (which is called the return spring in Patent Literature 1) that imparts restoring force to the operating lever 100 to return the pulled operating lever 100 to its original position. The operating lever 100 includes a pivot shaft 101 supported swingably by the spring member 200 and pockets 102. The spring member 200 includes a pair of spring pieces 204 that is formed integrally with a base portion 203 fixed to the main body portion (which is called the dispenser main body in Patent Literature 1). Each spring piece 204 is formed by two curved strips 205 and 206, and a lower end portion 207 that is received in the corresponding pocket 102 to impart resilience to the operating lever 100.

CITATION LIST

Patent Literature

PTL1: JPH11290731A

SUMMARY

Technical Problem

Since a large load is applied to the spring pieces that undergo elastic deformation while the base portion is fixed to the main body portion, long-term repeated use of the spring member as described above might cause a gradual decrease in elasticity and accordingly, plastic deformation of the spring member, and this might makes it difficult for the operating lever to return to the original position. In this case, the travel range of the operating lever might be diminished, resulting in a decrease in discharge dose.

The present disclosure is to provide a trigger-type liquid dispenser that prevents a decrease in discharge dose due to plastic deformation of the spring member caused by long-term repeated use.

Solution to Problem

One of aspects of the present disclosure for solving the aforementioned problem resides in a trigger-type liquid dispenser including an operating lever held swingably by a main body portion in which a pump is disposed and including a spring member that imparts restoring force to the operating lever, the trigger-type liquid dispenser being configured to draw, pressurize, and force-feed a content liquid contained in a container to dispense the content liquid through a nozzle, by actuating the pump in response to the operation lever being pulled repeatedly, wherein the main body portion includes a bearing or a shaft portion, the spring member includes at least one arm including one end having a shaft or a bearing portion held swingably by the bearing or the shaft portion included in the main body portion, another end abutting against the operating lever, and a curved portion connecting the one end and the other end, and in response to the operating lever being pulled, the curved portion undergoes elastic deformation and swings about the shaft portion of the main body portion or the spring member.

In a preferred embodiment of the trigger-type liquid dispenser according to the present disclosure, the spring member includes the shaft portion held swingably by the bearing portion included in the main body and a pair of the arms extending from both ends of the shaft portion of the spring member, and the shaft portion and the pair of the arms are formed integrally.

Advantageous Effect

The present disclosure provides a trigger-type liquid dispenser that prevents a decrease in discharge dose due to plastic deformation of the spring member caused by long-term repeated use.

DETAILED DESCRIPTION

Figure 1:
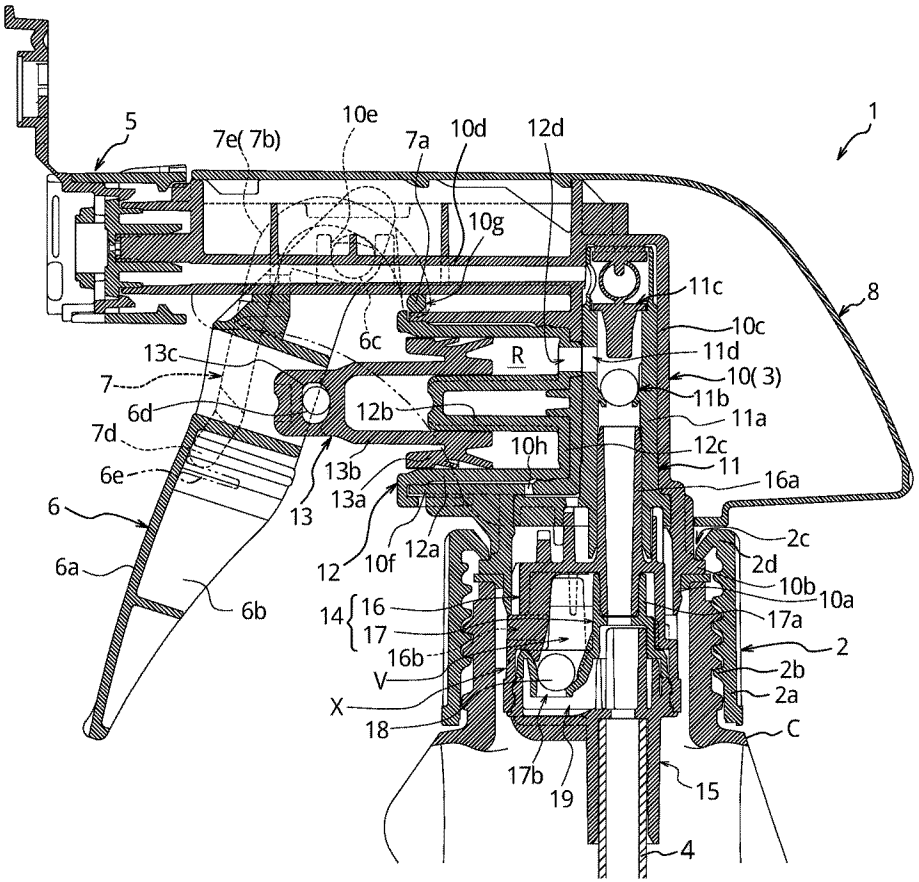
FIG. 1 is a side sectional view illustrating a trigger-type liquid dispenser according to one of embodiments of the present disclosure.

The present disclosure will be described in more detail below with reference to the drawings. Note that, in the specification, the claims, the abstract, and the drawings of the present disclosure, the side (corresponding to the upper side in FIG. 1) on which a top wall of a cover which is later described is located is defined as upper direction, and the side (corresponding to the lower side in FIG. 1) on which a fitting cap is disposed is defined as lower direction. Furthermore, the side (corresponding to the left side in FIG. 1) on which a nozzle is disposed is defined as front direction, and the opposing side (corresponding to the right side in FIG. 1) is defined as rear direction. Moreover, the directions (corresponding to the directions that are orthogonal to the drawing in FIG. 1) that are orthogonal to the upper-lower direction and the front-rear direction are defined as side directions.

In FIG. 1, reference numeral 1 denotes a trigger-type liquid dispenser according to one of embodiments. The trigger-type liquid dispenser 1 includes: a fitting cap 2 attached to a mouth of a container C; a main body portion 3 that holds the fitting cap 2 in a manner such that the fitting cap 2 is allowed to rotate and prevented from slipping off and that includes a pump configured to draw, pressurize, and force-feed a content liquid contained in the container C; a pipe 4 that is coupled to the main body portion 3, that extends toward a bottom of the container C, and that is configured to draw the content liquid contained in the container C by the pump being actuated; a nozzle 5 disposed in front of the main body portion 3 to dispense the content liquid to the outside; an operating lever 6 that is held swingably by the main body portion 3 and that actuates the pump by being pulled repeatedly; a spring member 7 that imparts restoring force to the operating lever 6; and a cover 8 that covers the upper and the side parts of the main body portion 3.

The fitting cap 2 is provided, on an inner surface of a cylindrical side wall 2*a* thereof, a screw portion 2*b* configured to engage with a screw portion provided in the mouth of the container C. Above the side wall 2*a*, a ceiling wall 2*d*, which is provided in the middle thereof with an upper opening 2*c*, is disposed.

In the present embodiment, the main body portion 3 is formed by a plurality of members, and the fitting cap 2 is attached to a body 10, which is one of the plurality of members. The body 10 includes a cylindrical coupling tubular portion 10*a* that is inserted through the upper opening 2*c* and a flange 10*b* that is disposed on an outer circumferential surface of the coupling tubular portion 10*a* and that extends to the outer side in the radial direction. Below the flange 10*b*, a packing is also disposed to be sandwiched between an upper end of the mouth of the container C and the flange 10*b*. Furthermore, the body 10 includes, above the coupling tubular portion 10*a*, a longitudinal tube 10*c*, whose diameter is smaller than that of the coupling tubular portion 10*a*, and also includes, above the longitudinal tube 10*c*, a horizontal tube 10*d* that extends toward the front and that is connected to the longitudinal tube 10*c*. The nozzle 5 is disposed in the front end portion of the horizontal tube 10*d*.

The horizontal tube 10*d* is provided with groove portions 10*e* which each have a U-shape whose upper side is opened in a side view. Below the horizontal tube 10*d*, a cylindrical fitting wall 10*f*, which extends toward the front from the longitudinal tube 10*c*, is disposed.

There is also disposed a tubular portion 11*a* of an intake 11 inside the longitudinal tube 10*c*. Furthermore, the tubular portion 11*a* of the intake 11 is provided, inside thereof, with the first check valve 11*b* and the second check valve 11*c* that prevent backflow of the content liquid drawn by the pump. The first check valve 11*b* is brought into an opened state when the content liquid is drawn by using a pump function and brought into a closed state when the drawn content liquid is pressurized and force-fed. On the other hand, the second check valve 11*c* is brought into a closed state when the content liquid is drawn by using the pump function and brought into a closed state when the drawn content liquid is pressurized and force-fed toward the nozzle 5.

Herein, there is disposed an upright and invert dual mechanism X between the pipe 4 and the intake 11 in the present embodiment. The upright and invert dual mechanism X allows the content liquid contained in the container C to be supplied to the main body portion 3 both in an upright and an inverted position of the container C. The upright and invert dual mechanism X includes a valve-mounted tubular member 14 disposed inside the mouth of the container C and a pipe attachment member 15 disposed below the valve-mounted tubular member 14.

The valve-mounted tubular member 14 is formed by a drawing member 16 including an inner tube 16*a* disposed inside the tubular portion 11*a* of the intake 11 and a valve member 17 including an outer tube 17*a* disposed on the outer side of a lower portion of the inner tube 16*a*. Between the drawing member 16 and the valve member 17, a valve chamber V, in which a valve body 18 is disposed, is formed. The drawing member 16 is provided with an inversion-time drawing hole 16*b* permitting the valve chamber V to communicate with the inside of the container C, and the valve member 17 is provided with a through hole 17*b* that is closed by the valve body 18 in the upright position of the container C and that is opened in the inverted position of the container C.

The pipe attachment member 15, to which the pipe 4 is coupled, is fitted to the drawing member 16 from below with the valve member 17 being interposed therebetween, and an inversion-time flow path 19 is formed between the pipe attachment member 15 and the valve member 17. The inversion-time flow path 19 communicates with the tubular portion 11*a* of the intake 11 via the inner tube 16*a*.

There is also provided a cylinder member 12 on the inner side of the fitting wall 10*f* of the body 10. The cylinder member 12 has a coaxial double-tube structure consisting of a cylindrical cylinder tube 12*a* that is fitted to and held by the fitting wall 10*f* and a cylindrical partition tube 12*b* that is disposed on the inner side of the cylinder tube 12*a* in the radial direction. The cylinder tube 12*a* and the partition tube 12*b* are connected to each other on the rear sides thereof via an inner wall 12*c*.

The inner wall 12*c* is provided with a hole 12*d* that is fitted in a hole of the longitudinal tube 10*c* and that communicates with a hole 11*d* of the intake 11. Furthermore, although not illustrated, the cylinder tube 12*a* is provided, on the side thereof, with an ambient air inlet that permits the inside of the cylinder tube 12*a* to communicate with the outside and that communicates with a hole 10*h* provided in the fitting wall 10*f* via a gap formed between the fitting wall 10*f* and the cylinder tube 12*a*.

Inside the cylinder member 12, a piston 13 is disposed. The piston 13 seals the inside of the cylinder member 12 and defines a cylinder chamber R. The piston 13 includes an annular slide portion 13*a* that slidably abuts against an inner circumferential surface of the cylinder tube 12*a*, and the slide portion 13*a* is provided with a circumferential wall portion 13*b* that extends toward the front and that has a closed front end. Additionally, the slide portion 13*a* closes the ambient air inlet provided in the cylinder member 12 in the state where the operating lever 6 is not pulled.

Thus, in the present embodiment, the main body portion 3 having the pump function is formed by the body 10, the intake 11, the upright and invert dual mechanism X, the cylinder member 12, and the piston 13.

The operating lever 6 in the present embodiment includes a front wall 6*a* and a pair of side walls 6*b* disposed on both sides of the front wall 6*a*. The operating lever 6 also includes a pair of columnar pivot shafts 6*c* that engages swingably with the pair of groove portions 10*e* provided in the horizontal tube 10*d* included in the body 10. The operating lever 6 is also provided with a columnar convex portion 6*d* that engages with an engagement concave portion 13*c* of the piston 13.

Figure 2C:
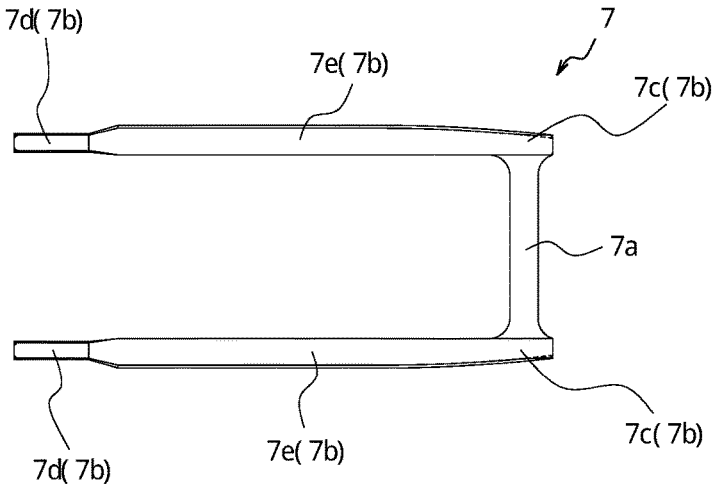
FIG. 2C is a plan view illustrating a spring member included in a trigger-type liquid dispenser of FIG. 1.
Figure 2A:
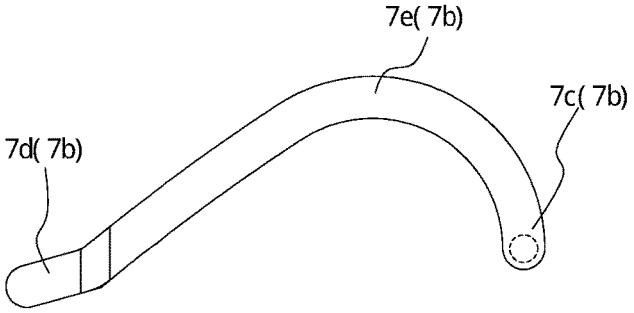
FIG. 2A is a side view.
Figure 2B:
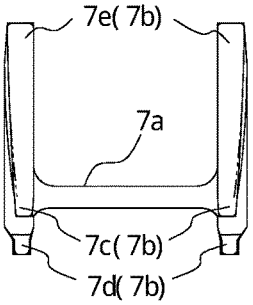
FIG. 2B is a back view.

Herein, as illustrated in detail in FIGS. 2A to 2C, the spring member 7 in the present embodiment includes a columnar shaft portion 7*a* and a pair of arms 7*b* extending from both ends of the shaft portion 7*a*, and the shaft portion 7*a* and the pair of arms 7*b* are formed integrally. Each arm 7*b* is formed by one end 7*c* in which the shaft portion 7*a* is disposed, the other end 7*d* that abuts against the operating lever 6, and a curved portion 7*e* that connects the one end 7*c* and the other end 7*d*. Herein, the spring member 7 in the present embodiment may be made of a resin material. However, the present disclosure is not limited to this embodiment. The shaft portion 7*a* and the arms 7*b* of the spring member 7 may also be formed as separate members which may be connected by, for example, an adhesive, or alternatively, the arms 7*b* may be coupled swingably to the shaft portion 7*a* formed separately.

As illustrated in FIG. 1, the shaft portion 7*a* is held swingably by the bearing portion 10*g* disposed between the horizontal tube 10*d* and the fitting wall 10*f* of the body 10, and the pair of curved portions 7*e* is disposed on both sides in a manner such that the horizontal tube 10*d* is sandwiched by the curved portions 7*e*. The other end 7*d* abuts against the front wall 6*a* of the operating lever 6 and is supported from below by a support rib 6*e* provided on an inner surface of each side wall 6*b*. Additionally, in response to the operating lever 6 being pulled, the support rib 6*e* serves as a pressing portion that presses the other end 7*d* of the arm 7*b* toward the one end 7*c*.

The way of holding the spring member 7 swingably with respect to the main body portion 3 is not limited to the structure according to the present embodiment, and another structure may also be adopted. For example, the bearing portion may be provided in the spring member 7, and the shaft portion, configured to engage with the bearing portion, may be provided in the main body portion 3.

Figure 3:
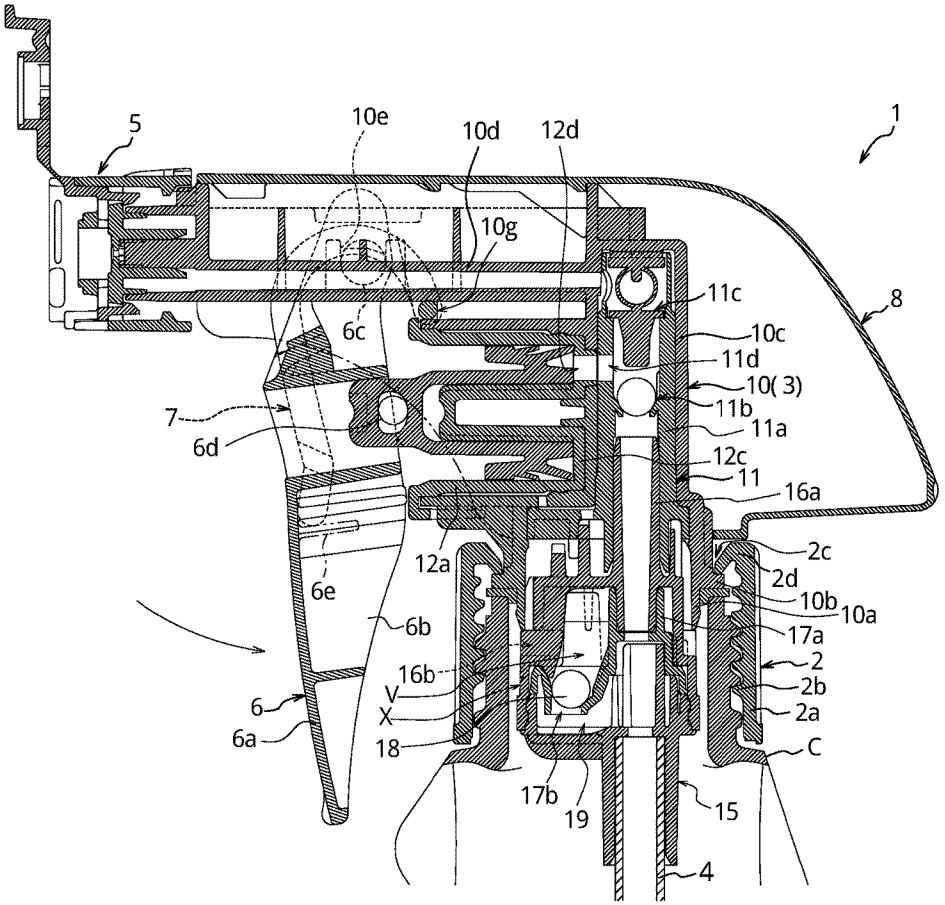
FIG. 3 illustrates a pulled state in which an operating lever included in a trigger-type liquid dispenser of FIG. 1 is pulled.
Figure 4:
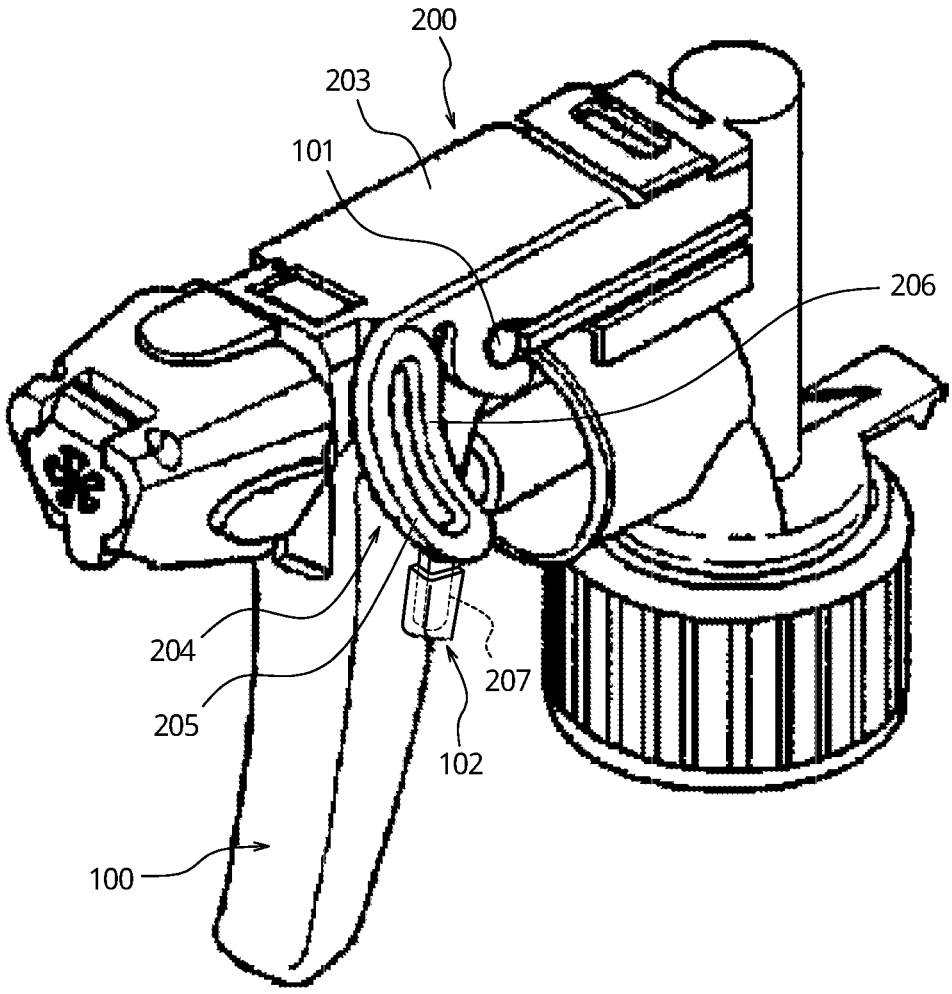
FIG. 4 is a perspective view illustrating a portion of a conventional trigger-type liquid dispenser.

FIG. 3 illustrates a pulled state in which the operating lever 6 is pulled from an initial state illustrated in FIG. 1. In the trigger-type liquid dispenser 1 according to the present embodiment, once the operating lever 6 is pulled from the initial state to cause the piston 13 to retract to the rear with respect to the cylinder member 12, the liquid contained in the cylinder chamber R is pressurized, and the pressurized liquid passes through the holes 12*d* and 11*d* and the second check valve 11*c*, and then through the inside of the horizontal tube 10*d*, to be injected from the nozzle 5 to the outside. Subsequently, when being released, the operating lever 6 swings toward the front due to the restoring force of the spring member 7, and accordingly, the piston 13 is caused to advance to the front with respect to the cylinder member 12. Consequently, the cylinder chamber R is placed under negative pressure. Thus, the liquid contained in the container C is drawn via the pipe 4 in the upright position and via the inversion-time drawing hole 16*b*, the through hole 17*b*, and the inversion-time flow path 19 in the inverted position, and the drawn liquid pushes up the first check valve 11*b* to flow into the cylinder chamber R. By thus pulling and releasing the operating lever 6 repeatedly, the liquid contained in the container C may be injected from the nozzle 5 successively.

In the trigger-type liquid dispenser 1 according to the present disclosure that has the aforementioned structure, each arm 7*b* undergoes elastic deformation and swings about the shaft portion 7*a* from the initial state illustrated in FIG. 1 to the pulled state illustrated in FIG. 3. Accordingly, compared with conventional cases where a spring member undergoes elastic deformation while a portion of the spring member is fixed to the main body portion, the magnitude of deformation of the spring member 7 undergoing elastic deformation is reduced. This reduces load applied to the spring member 7 and prevents occurrence of plastic deformation caused by long-term repeated use, and therefore, a decrease in discharge dose is prevented. Furthermore, since the magnitude of deformation of the spring member 7 undergoing elastic deformation is reduced, the operating lever 6, when being pulled, does not generate an excessive repulsive force and may be pulled easily with slight force.

Moreover, since the shaft portion 7*a* and the pair of arms 7*b* are formed integrally in the trigger-type liquid dispenser 1 according to the present embodiment, the number of members is reduced, and manufacturing cost and time are reduced.

Although the present disclosure has been described based on the illustrated examples, the present disclosure is not limited to the above embodiment and may be changed as appropriate within the scope of the claims. For example, although in the present embodiment the spring member includes the pair of arms 7*b*, the spring member may include only a single arm. Furthermore, the shape of the curved portion 7*e* is not limited to the illustrated shape. Moreover, the internal structure of the main body portion 3 that provides the pump function is not limited to the one according to the present embodiment, and any other commonly used structure may be adopted.

REFERENCE SIGNS LIST

1 Trigger-type liquid dispenser
2 Fitting cap
2*a* Side wall
2*b* Screw portion
2*c* Upper opening
2*d* Ceiling wall
3 Main body portion
4 Pipe
5 Nozzle
6 Operating lever
6*a* Front wall
6*b* Side wall
6*c* Pivot shaft
6*d* Convex portion
6*e* Support rib
7 Spring member
7*a* Shaft portion
7*b* Arm
7*c* One end
7*d* Other end
7*e* Curved portion
8 Cover
10 Body
10*a* Coupling tubular portion
10*b* Flange
10*c* Longitudinal tube
10*d* Horizontal tube
10*e* Groove portion
10*f* Fitting wall
10*g* Bearing portion
10*h* Hole
11 Intake
11*a* Tubular portion
11*b* First check valve
11*c* Second check valve
11*d* Hole
12 Cylinder member
12*a* Cylinder tube
12*b* Partition tube
12*c* Inner wall
12*d* Hole

13 Piston
13*a* Slide portion
13*b* Circumferential wall portion
13*c* Engagement concave portion
14 Valve-mounted tubular member
15 Pipe attachment member
16 Drawing member
16*a* Inner tube
16*b* Inversion-time drawing hole
17 Valve member
17*a* Outer tube
17*b* Through hole
18 Valve body
19 Inversion-time flow path
C Container
R Cylinder chamber
V Valve chamber
X Upright and invert dual mechanism

The invention claimed is:

1. A trigger-type liquid dispenser comprising:

an operating lever held swingably by a main body portion in which a pump is disposed; and a spring member that imparts restoring force to the operating lever, the trigger-type liquid dispenser being configured to draw, pressurize, and force-feed a content liquid contained in a container to dispense the content liquid through a nozzle, by actuating the pump in response to the operating lever being pulled repeatedly, wherein the main body portion includes a bearing or a shaft portion, the spring member includes at least one arm including one end having a shaft or a bearing portion held swingably by the bearing or the shaft portion included in the main body portion, another end abutting against the operating lever, and a curved portion connecting the one end and the other end, in response to the operating lever being pulled, the pair of curved portions undergo elastic deformation and swing about the shaft portion of the main body portion or the spring member, the main body portion includes a longitudinal tube, a horizontal tube which extends toward a front of the main body and that is connected to the longitudinal tube, and a cylindrical fitting wall which extends toward the front from the longitudinal tube and holds a cylinder member below the horizontal tube, and the bearing or the shaft portion is disposed between the horizontal tube and the cylindrical fitting wall of the main body portion.

2. The trigger-type liquid dispenser of claim 1, wherein the spring member includes the shaft portion held swingably by the bearing portion included in the main body and a pair of arms, including the at least one arm, extending from both ends of the shaft portion of the spring member, and the shaft portion and the pair of arms are formed integrally.

* * * * *